US005775957A

United States Patent [19]

Fink et al.

[11] Patent Number: 5,775,957

[45] Date of Patent: Jul. 7, 1998

[54] ELECTRICAL CONNECTOR

[75] Inventors: Randy Lynn Fink; Brian Matthew Donato, both of Warren, Ohio

[73] Assignee: General Motors Corporation, Detroit, Mich.

[21] Appl. No.: 716,958

[22] Filed: Sep. 23, 1996

[51] Int. Cl.[6] ..... H01R 13/436

[52] U.S. Cl. ..... 439/752; 439/595

[58] Field of Search ..... 439/752, 595, 439/701

[56] References Cited

U.S. PATENT DOCUMENTS 4,894,017 1/1990 Stein et al. ..... 439/78

4,946,402 8/1990 Fink et al. ..... 439/274

4,963,103 10/1990 Fink et al. ..... 439/352

5,496,184 3/1996 Garrett et al. ..... 439/79

*Primary Examiner*—Gary F. Paumen

*Attorney, Agent, or Firm*—Anthony Luke Simon

[57] ABSTRACT

An electrical connector comprising: an outer housing; a cavity within the outer housing; a inner housing within the cavity; a plurality of cylindrical openings within the inner housing, a plurality of conductive female terminals, wherein a portion of each conductive female terminal extends through one of the cylindrical openings; a channel on an end of the inner housing; and a lock bar in the channel, maintaining the plurality of conductive female terminals in place.

13 Claims, 5 Drawing Sheets

ELECTRICAL CONNECTOR

This invention relates to an electrical connector.

BACKGROUND OF THE INVENTION

Electrical connector systems are known for use in automotive vehicles to facilitating removable connection of electrical harnesses.

SUMMARY OF THE PRESENT INVENTION

Advantageously, this invention provides an electrical connector suitable for implementation as a high-power, multi-row connector.

Advantageously, this invention provides an electrical connector that houses a series of female terminals. The terminals are retained in an inner housing, including a series of flex arms for maintaining the terminals in place. The inner housing is separate from the outer housing and is maintained in a cavity in the outer housing. This combination allows implementation of a secondary lock feature, advantageously incorporated according to this invention, for insuring full engagement of all terminals within the inner and outer housings and increasing retention force of the terminals within the housings.

Advantageously then, according to a preferred example, this invention provides an electrical connector comprising: an outer housing; a cavity within the outer housing; an inner housing within the cavity; a plurality of cylindrical openings within the inner housing, a plurality of conductive terminals, wherein a portion of each conductive terminal extends through one of the cylindrical openings; a channel on a first end of the first inner housing; and a lock bar in the channel, maintaining the first plurality of conductive terminals in place.

BRIEF DESCRIPTION OF THE DRAWINGS

The present invention will now be described by way of example with reference to the following drawings in which.

DETAILED DESCRIPTION OF THE INVENTION

Figure 1:
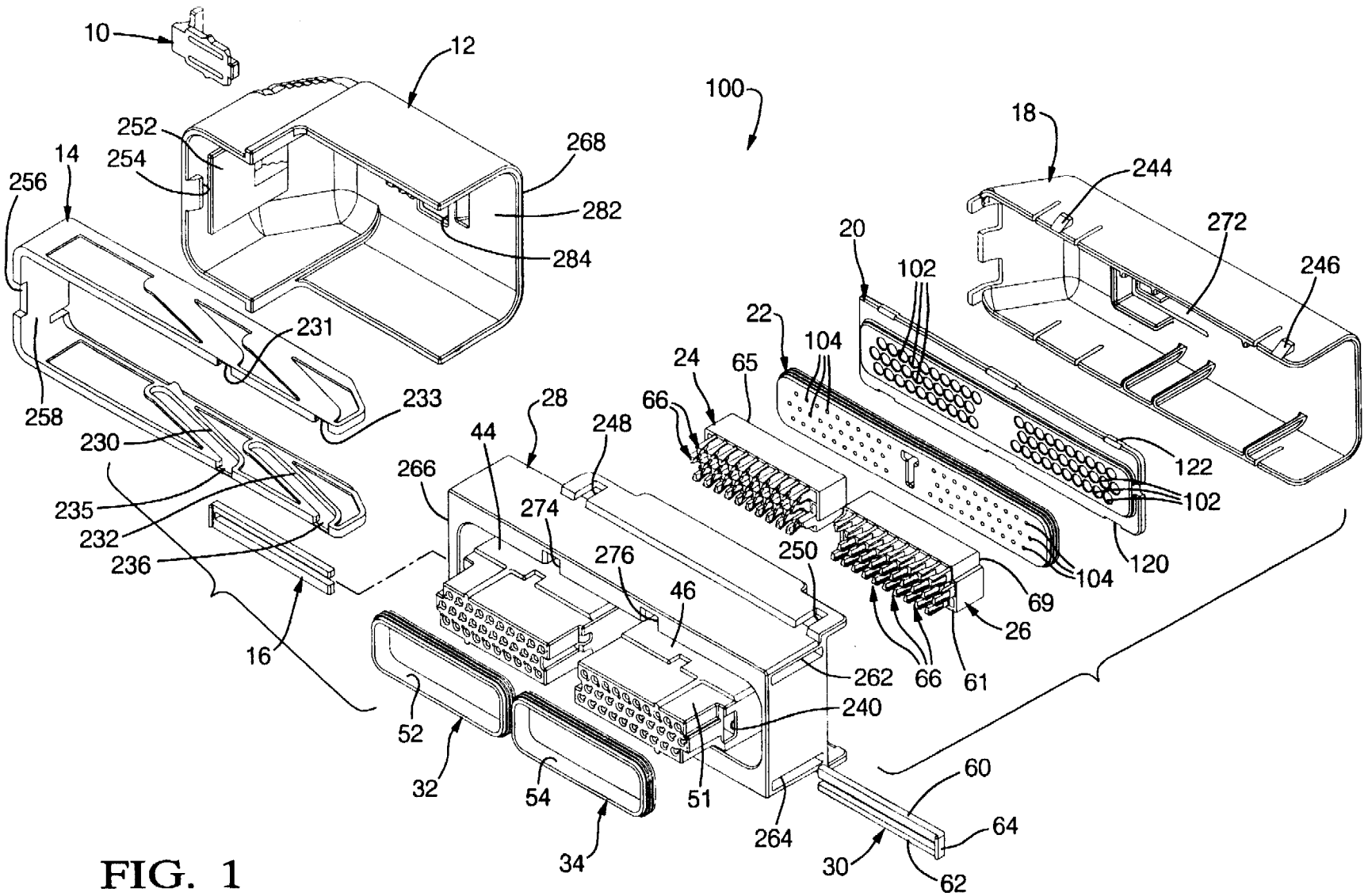
FIG. 1 illustrates an exploded view of an example female electrical connector according to this invention.
Figure 2:
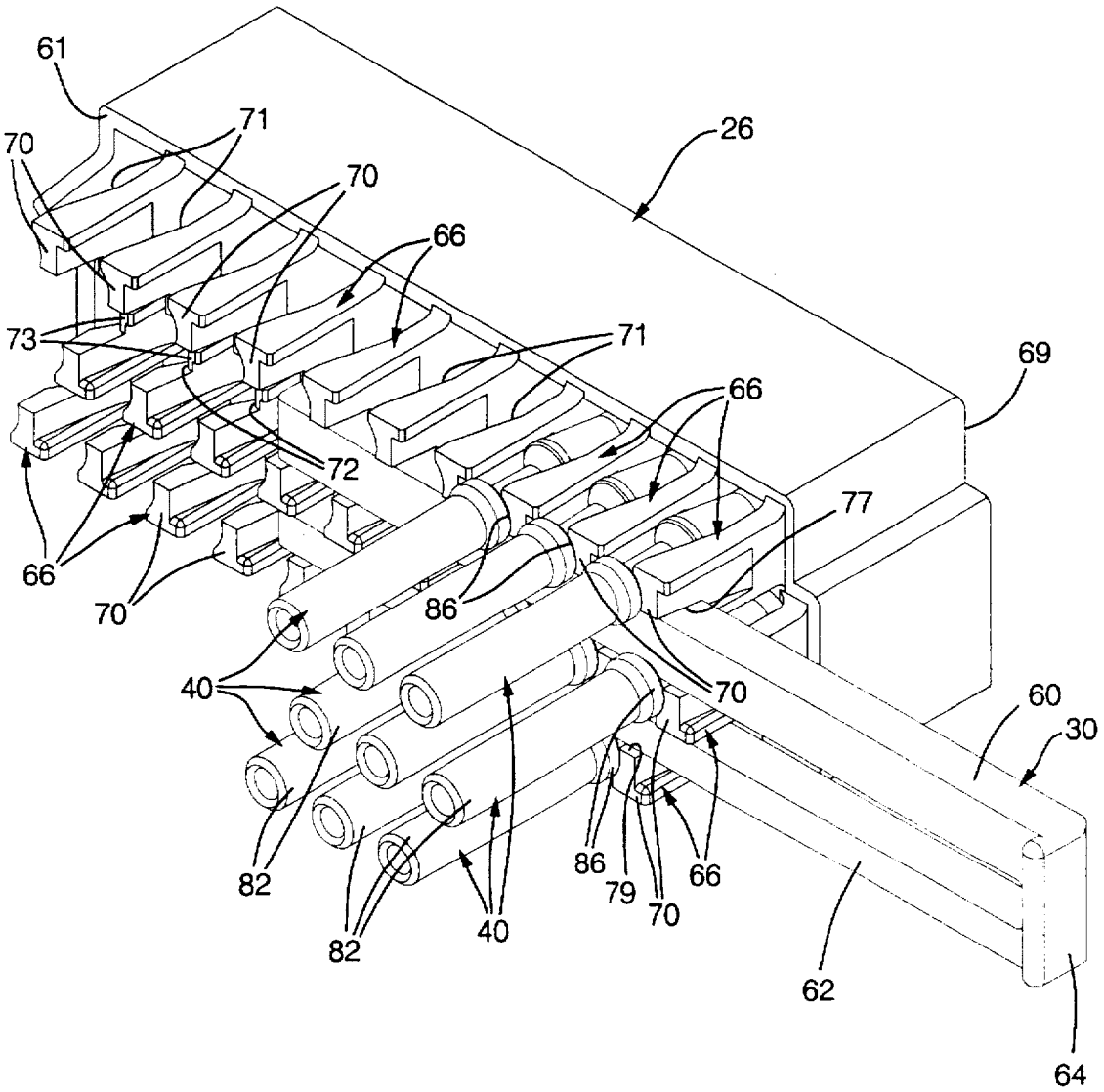
FIG. 2 illustrates operation of an example secondary lock feature according to this invention.

Referring now to FIGS. 1–4, the example female electrical connector 100 shown comprises outer housing 28, inner housings 24 and 26, cable seal 22, strain relief plate 20, wire dress cover 18, comb locks 16 and 30, connector seals 32 and 34, slide 14, slide assist 12 and connector position assurance component (CPA) 10.

The inner housings 24 and 26 each contain a plurality of flex arms (extensions) 66 aligned with the plurality of cylindrical openings 67. Each flex arm 66 has an end surface 70 at the end of the flex arm 66 and a ramp 71 on the flex arm. Using inner housing 26 as an example, the terminals 40 are inserted into the openings 67 in the inner housing 24 from side 69 of the inner housing 24. The terminals are pushed through the openings 67 until they project out of the other side 61 of the housing between the various flex arms 66. Each terminal pushes on the ramp 71 on the flex arm 66, which flexes in a cantilever motion and then snaps in place behind shoulder 86 of the terminal 40 so that shoulder 86 seats on the seat surface 70, maintaining the terminal 40 in place.

Figure 3:
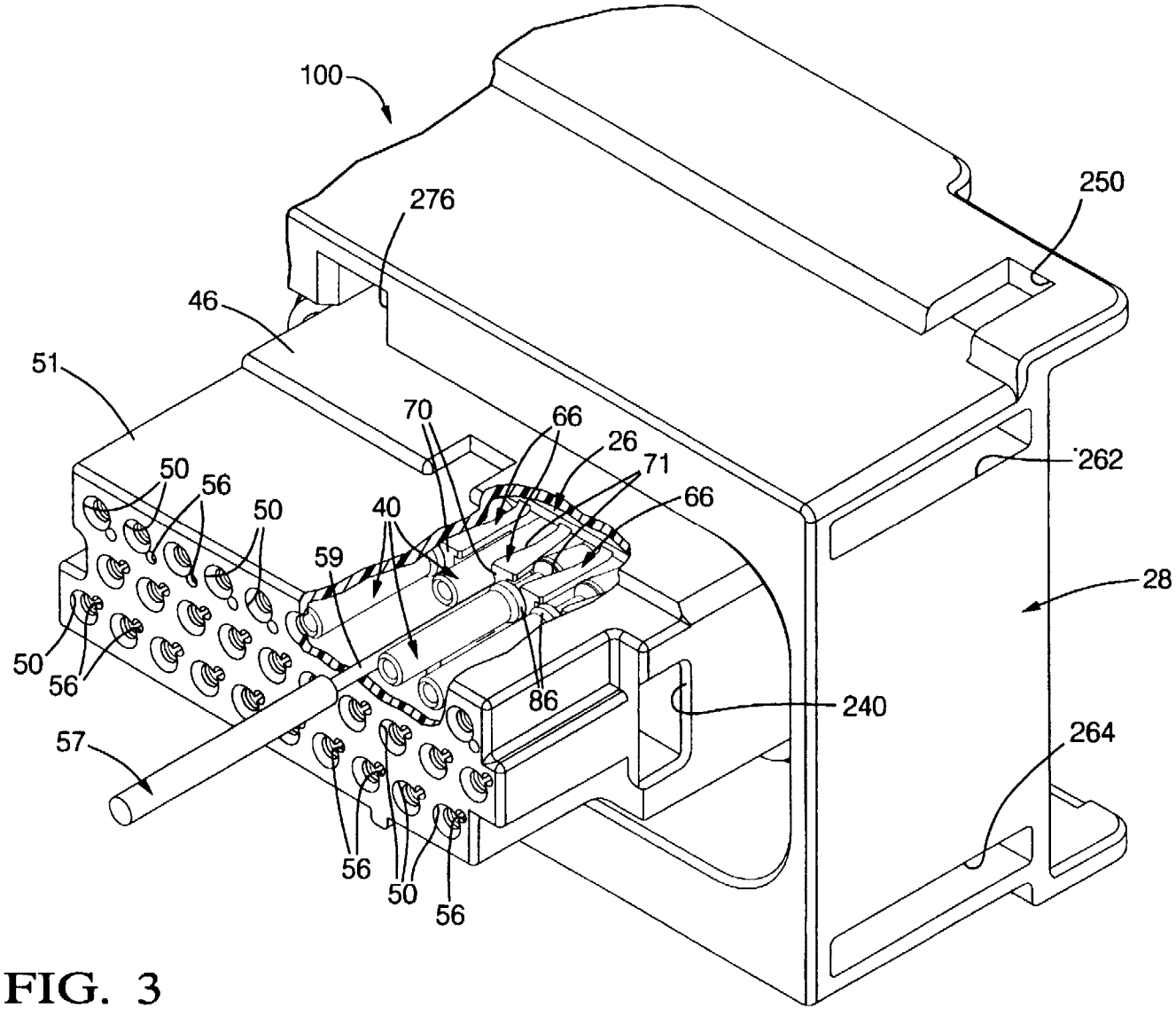
FIG. 3 illustrates an example feature allowing for removal of the electrical terminals from the electrical connector.
Figure 7:
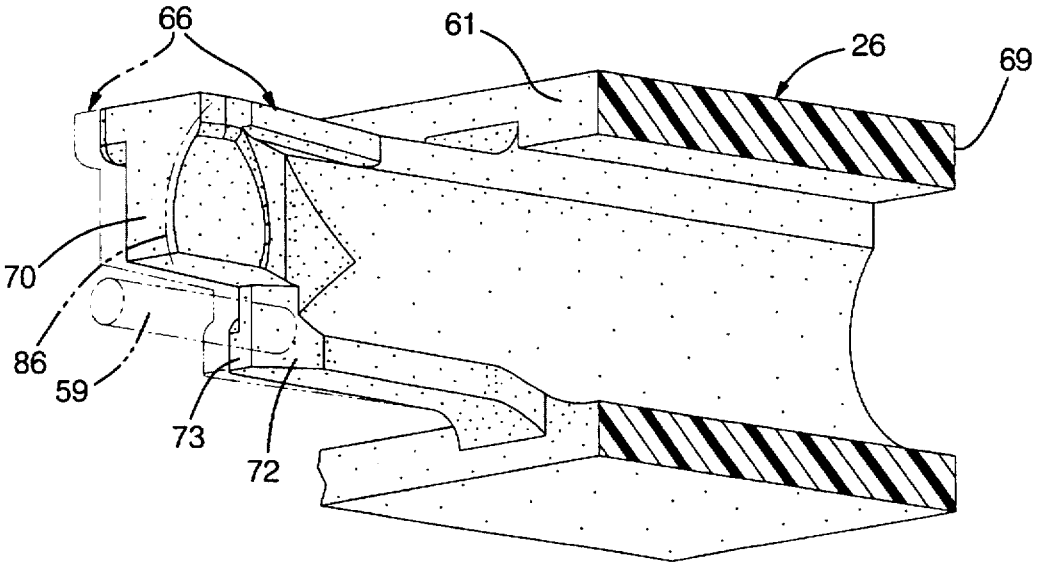
FIG. 7 illustrates an example flex arm of an inner housing for uses with this invention.

Referring now also to FIG. 7, each flex arm 66 also includes a ramp 72 associated therewith, located between the ends of the flex arm 66. Each ramp 72 has a top surface 73 extending laterally from the flex arm 66 at a point between the ends of the flex arm 66, providing a seat to the lock bars 60, 62, as described below. Each ramp 72 is positioned so that when the inner housing is assembled into the outer housing 28, each ramp 72 is aligned with one of the access holes 56 (FIG. 3). The access holes 56 allow access of a small tool 57, for example, having a 0.8 mm round rod 59, to extend through the access hole 56 and deflect the flex arm 66 through cam action with the ramp 72, allowing seat surface 70 to disengage from the shoulder 86 of the terminal 40 and allowing removal of the terminal 40 from the inner and outer housings 26 and 28, i.e., from the end 69 of the inner housing 26.

After the terminals 40 are inserted in the inner housing 26, the housing is inserted into the cavity 36 of outer housing 28 causing terminal ends 82 to extend into the cylindrical cavities 84 of the terminal position portion 51 of outer housing 28. Each cavity 84 has an inner seat 80 preventing the terminal end 82 from extending out of the opening 50 of outer housing 28.

After the inner housing 26 is inserted in the outer housing 28, cable seal 22 is inserted in place abutting the inner housings 24 and 26, i.e., adjacent end surfaces 69 and 65 of inner housings 26 and 24. The cable seal 22 has a plurality of openings 104 through which the terminals 40 extend. The cable seal 22 is maintained in place by strain relief plate 20, also containing a series of openings 102 through which the terminals 40 extend. The strain relief plate is snapped in place by a plurality of cantilever arms 108 and 110 having locking seats 112 and 114 on the ends 116 and 118 thereof locking against seats 120 and 122 of the strain relief plate 20.

The cable seal 22 is constructed of a resilient material such as an elastomer or rubberized foam and provides a spring force against the end 69 of the inner housing 26 and the similar end 65 of housing 24. Because the inner housing is separate from the outer housing 28 and is maintained in place by resilient member 22, there is some free play allowed in position of the inner housing 26 within outer housing 28.

Comb locks 16 and 30 both operate in the same way to lock the inner housing within the outer housing and ensure that the terminals 40 are appropriately positioned and locked in place. Using comb lock 30 as an example, comb lock 30 has a closed end 64 and two extending locking bars 60 and 62 projecting from the closed end 64 so that the comb lock 30 has a generally elongated U-shape.

The flex arms 66 on the inner housing 26 are arranged in spaced-apart rows that form channels 77, 79 for the lock bars 60 and 62 on the comb lock 30. Likewise, the terminals 40, when positioned in inner housing 26, are aligned in the same three rows as the flex arms 66. Each row comprises, alternately placed flex arms 66 and terminals 40. When the inner housing 26 is placed within the outer housing 28 and the terminals 40 are in place, the comb lock 30 is slid through opening 240 in the outer housing and the lock bars 60 and 62 slide down the channels 77, 79, riding along the top surfaces 73 of the ramps 72 of the flex arms 66. Once in the channels, the lock bar aids retention of each terminal 40 in place by providing a locking surface for seat 86 on the terminal 40, preventing terminal 40 from being removed and by engaging with the opening 240 of the outer housing preventing the inner housing from being removed from the outer housing 28.

The resilient cable seal 22 is under some compression due to the strain relief plate 20 being snapped in place into housing 28. This provides spring force against the ends 65, 69 of the inner housings 24, 26 pressing inner housings 24, 26 toward the positioning end 51 of the housing 28 and providing friction lock of the lock bars 60 and 62 in place between the surfaces 73 and the inner end wall 242 of the cavity 36.

Figure 4:
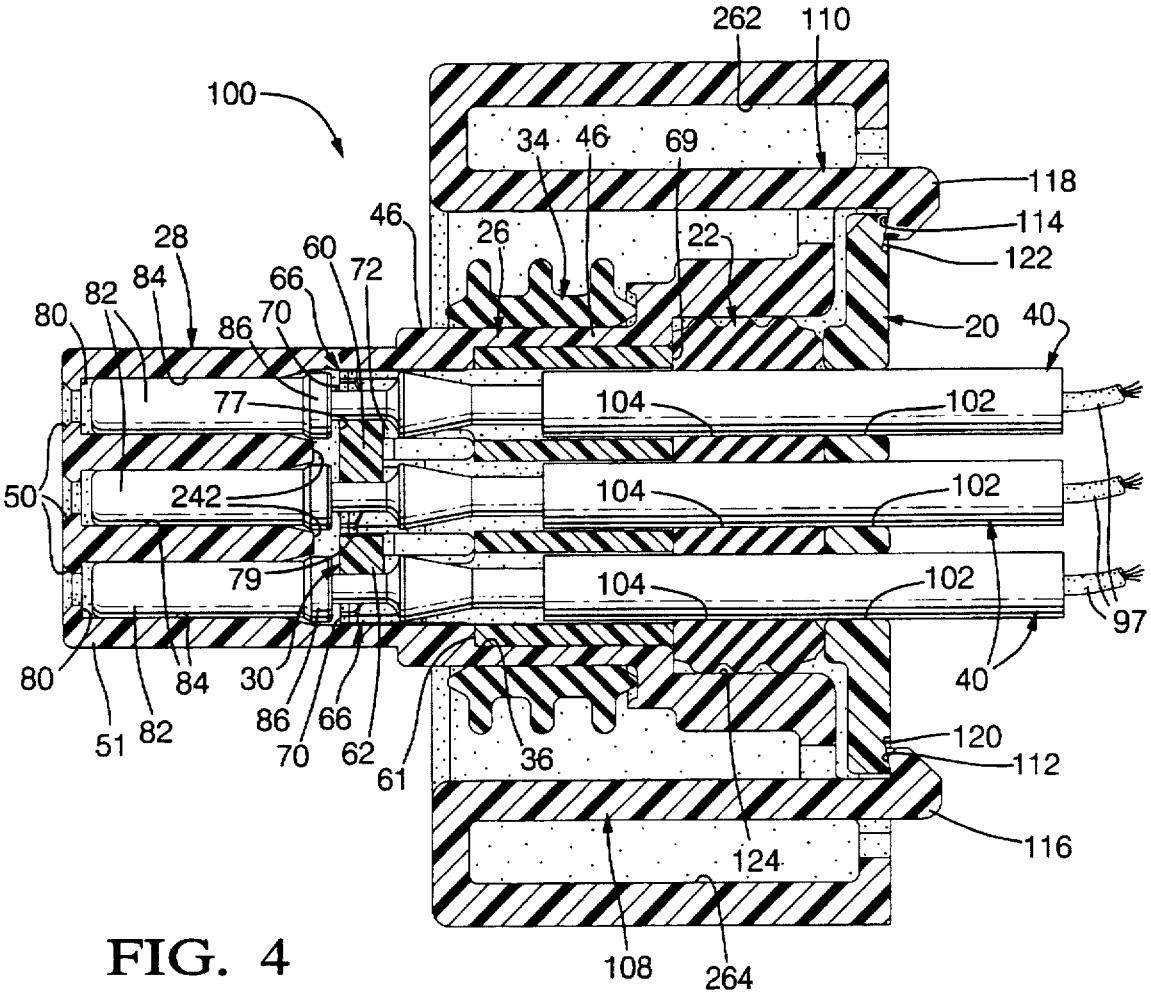
FIG. 4 illustrates a section view of an example electrical connector according to this invention.

As illustrated in FIG. 4, each terminal 40 has an electrical wire 97 connected thereto in a known manner, for example, through crimping, and the wires 97 generally comprise part of one or more harnesses in an electrical system, for example, for a motor vehicle. The dress cover 18 snaps in place to outer housing 28 with ramp and locks 244 and 246 engaging slots 248 and 250 on the outer housing.

Connector seals 32 and 34 of a known type have inner seal surfaces 52 and 54 that fit snugly on outer surfaces 44 and 46 of the connection end of outer housing 28. The outer surfaces of the seals 32, 34 engage inner surfaces 290, 292 of the shroud 202 (FIG. 5) of the male terminal 200.

Figure 5:
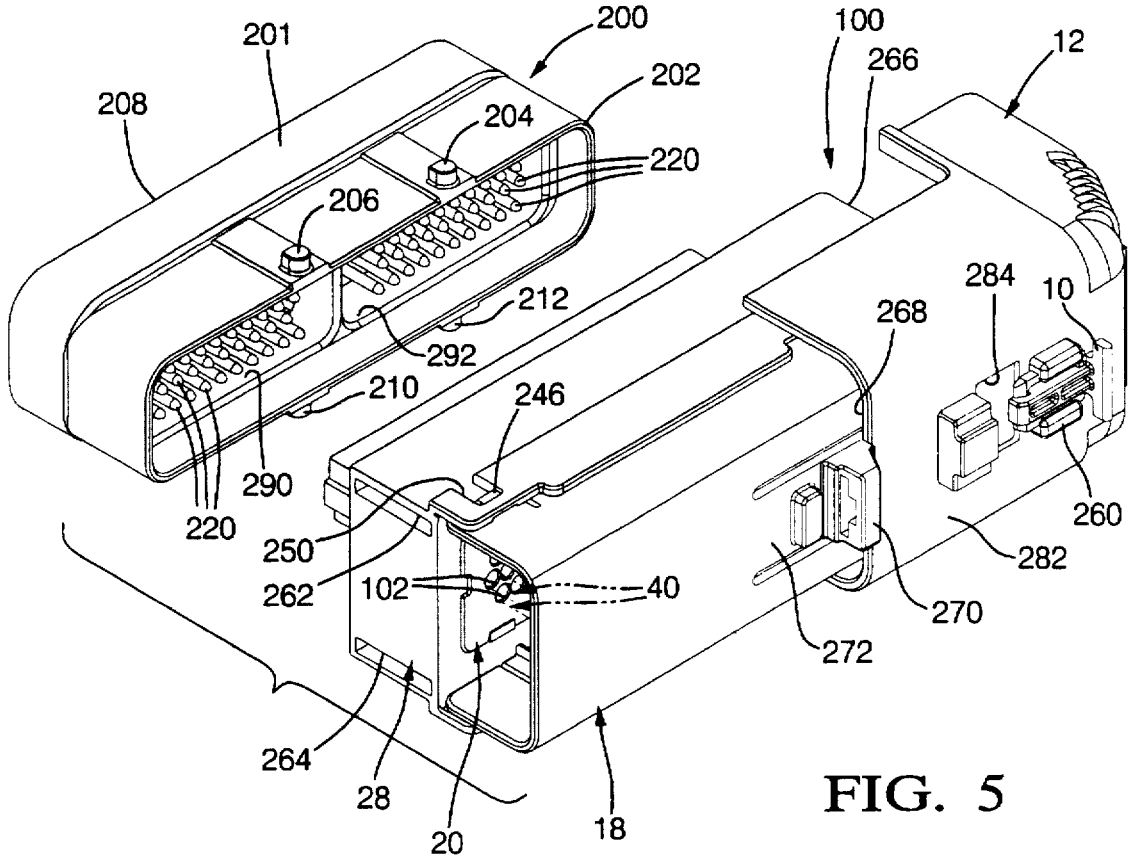
FIGS. 5 and 6 illustrate example engagement of male and female electrical connectors according to this invention.
Figure 6:
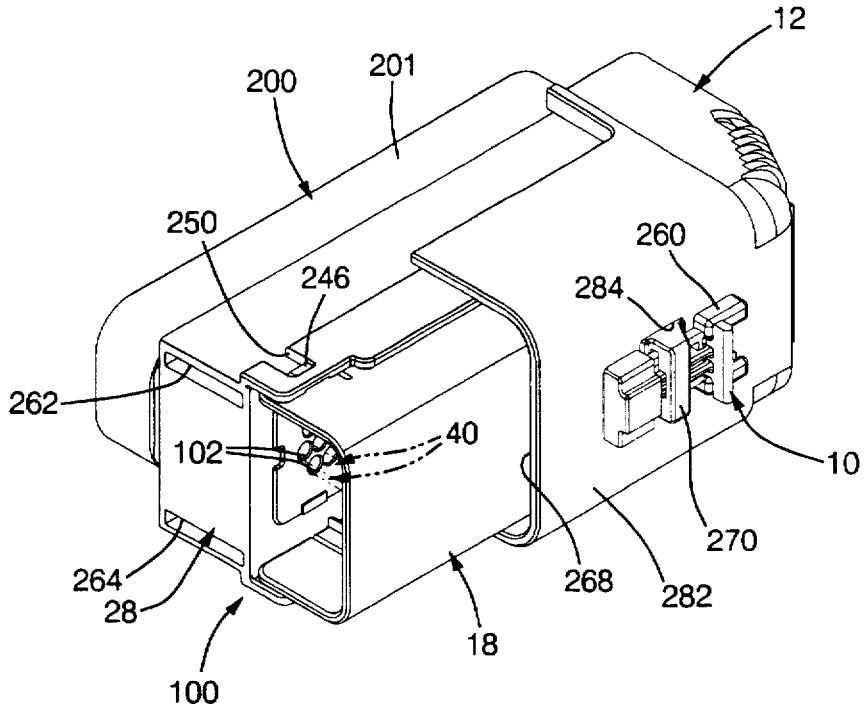

Referring now to FIGS. 5 and 6, the engagement of the female connector 100 with male connector 200 is illustrated. The male connector 200 generally has a structure of a known type and includes housing 201 with extending shroud 202. Extending out of the extending shroud 202 are four buttons 204, 206, 210, 212 for locking with the female connector 100. Within the shroud 201 are a plurality of male terminals 220 for engaging the female terminals 40 of the female connector 100 in a known manner. A plurality of cable wires (not shown) are connected to the male terminals 220 and extend out the male connector 200 in a known manner.

To mate the connectors 100 and 200, the slide 14 is first snapped into position into assist cover 12 with tab 252 engaging end 258 of the slide so that notch 256 is seated behind lock 254 of the assist cover 12. The CPA 10 is also snapped in place in intermediate holder 260 molded on the exterior of assist cover 12. With the slide 14, CPA 10 and the assist cover 12 so assembled, the slide is inserted into the slots 262 and 264 in the outer housing 28 from the end 266 thereof and slid in place until the front surface 268 of assist cover 12 bumps against the front of the CPA lock feature 270, located on cantilever finger 272 on the top of wire shroud 18. In this position, the male connector is ready to be assembled to the female connector and the slot inlets 231, 233, 235 and 236 are aligned with the slots 274, 276 and two other slots not shown of the outer housing 28.

The male connector 200 is then aligned so that the tabs 204, 206, 210 and 212 enter the slots 274, 276 and the two slots not shown beginning engagement of the male terminals 220 to the female terminals 40. Force is then applied on the assist cover 12 to slide the slide 14 more into the outer housing 28. Deflection of cantilever arm 272 is necessary to allow surface 268 past feature 270 of the wire shroud 18. Through the resulting motion, the inner slot ramps 230, 232 (only two shown) act on the tabs 204, 206, 210, 212 of the male connector 200 forcing the connector into full engagement with the female connector and mating the male/female connectors 200 and 100 together.

During this process, the lock feature 270 is forced underneath the side 282 of the cover 12 through cantilever action of finger 272. The male/female connectors 200 and 100 are not fully engaged until the CPA lock feature 270 pops into position in opening 284 in cover 12. Once in this position, the CPA 10 can be slid forward from its engagement position in the retainer 260 to a snap-lock position in feature 270. If CPA 10 cannot slide forward and snap into the snap-lock position in feature 270, then the terminal is not completely engaged. Once the terminals are completely engaged and the CPA lock is slid into position, the terminals are locked in place and cannot be disengaged until the CPA 10 is removed.

The housings 24, 26 and 28, the strain relief plate 20, the wire dress cover 18, the slide 14, the slide assist 12, the comb locks 16 and 30 and the CPA 10 can all be molded out of plastic, vinyl or other suitable material.

We claim:

1. An electrical connector comprising:

an outer housing;

a cavity within the outer housing;

a first inner housing within the cavity;

a first plurality of cylindrical openings within the first inner housing;

a first plurality of conductive terminals, wherein a portion of each conductive terminal of the first plurality of conductive terminals extends through one of the cylindrical openings;

a plurality of extensions aligned in at least first and second extension rows on a first end of the inner housing, wherein each extension includes a ramp for facilitating cantilever deflection of the extension when one of the conductive terminals is inserted in the first inner housing and wherein each extension includes a seat for locking said one of the conductive terminals in place:

a first channel located between the first and second extension rows on the first end of the first inner housing; and a first lock bar in the first channel, maintaining the first plurality of conductive terminals in place.

2. An electrical connector according to claim 1, wherein the conductive terminals are aligned in first and second terminal rows and wherein the first channel extends between the first and second terminal rows.

3. An electrical connector according to claim 2, wherein each of the conductive terminals includes a shoulder that contacts the first lock bar, wherein the first lock bar maintains the conductive terminals in place.

4. An electrical connector according to claim 2, wherein the conductive terminals are also aligned in a third terminal row, wherein the first, second and third terminal rows are parallel, wherein the electrical connector also comprises:

a second channel on the first end of the first inner housing; and a second lock bar in the second channel, wherein the first channel is between the first and second terminal rows and wherein the second channel is between the second and third terminal rows.

5. An electrical connector according to claim 4, wherein the first and second lock bars comprise part of a unshaped comb lock.

6. An electrical connector according to claim 1, also comprising:

a second inner housing within the cavity located adjacent the first inner housing;

a second channel on a first end of the second inner housing;

a second plurality of cylindrical openings within the second inner housing;

a second plurality of conductive terminals, wherein a portion of each conductive terminal of the second plurality of conductive terminals extends through one of the cylindrical openings of the second plurality of cylindrical openings; and a second lock bar in the second channel, maintaining the second plurality of conductive terminals in place in the second inner housing.

7. An electrical connector according to claim 1, wherein at least some of the extensions include laterally extending seats located between opposite longitudinal ends of the at least some of the extensions, wherein the lock bar seats against the laterally extending seats.

8. An electrical connector according to claim 1, wherein each cylindrical opening within which is located one of the conductive terminals has a corresponding extension of the plurality of extensions.

9. An electrical connector according to claim 1, wherein the outer housing includes a plurality of receptacles for receiving ends of the first plurality of conductive terminals extending out of the first inner housing.

10. An electrical connector according to claim 9, wherein the outer housing includes a plurality of access holes, wherein each receptacle has located proximate thereto one of the access holes, wherein each extension includes a deflection ramp aligned with one of the access holes.

11. An electrical connector according to claim 5, wherein the outer housing includes an opening within which an end of the comb lock is located.

12. An electrical connector comprising:

an outer housing for a female connector;

a plurality of first cylindrical openings within the outer housing;

a plurality of conductive female terminals, having female connection ends within the cylindrical openings;

a cavity within the outer housing, wherein the plurality of cylindrical openings open to the cavity;

a first inner housing within the cavity;

a plurality of second cylindrical openings within the first inner housing, wherein each second cylindrical opening is axially aligned with one of the first cylindrical openings, wherein a portion of each conductive female terminal extends through one of the second cylindrical openings;

a first channel on a first end of the first inner housing proximate to the first cylindrical openings;

a resilient surface pressing against a second end of the first inner housing opposite the first end; and a first lock bar in the channel, maintaining the conductive female terminals in place, wherein force exerted by the resilient surface on the first inner housing maintains the first lock bar in place, pressed between the first inner housing and the outer housing.

13. An electrical connector comprising:

an outer housing;

at least one cavity within the outer housing;

a plurality of inner housings within the at least one cavity;

a plurality of cylindrical openings within each inner housing, a plurality of conductive terminals in each inner housing, wherein a portion of each conductive terminal extends through one of the cylindrical openings;

in each inner housing:

(a) a plurality of extensions aligned in at least first and second extension rows on an end of the inner housing, wherein each extension includes a first seat for locking one of the conductive terminals in place and wherein at least some of the extensions include laterally extending second seats located between opposite longitudinal ends of the at least some of the extensions.

(b) a channel located between the first and second extension rows on the end of the inner housing; and (c) a lock bar in the channel, seated against the second seats to maintain the conductive terminals in place.

* * * * *